US005183153A

United States Patent [19]

Linn

[11] Patent Number: 5,183,153

[45] Date of Patent: Feb. 2, 1993

[54] PAD HOLDER

[76] Inventor: Richard A. Linn, 4237 Thomas Ave. N., Minneapolis, Minn. 55142

[21] Appl. No.: 747,724

[22] Filed: Aug. 19, 1991

Related U.S. Application Data

[63] Continuation-in-part of Ser. No. 571,993, Aug. 24, 1990, Pat. No. 5,060,794.

[51] Int. Cl.[5] ..... A45C 11/32

[52] U.S. Cl. ..... 206/232; 206/38.1; 206/447; 206/39; 206/39.1

[58] Field of Search ..... 206/37.1, 37.4, 38.1, 206/39, 39.1, 39.3, 39.4, 39.5, 232, 371, 555, 447, 815, 816, 805; 224/252

[56] References Cited

U.S. PATENT DOCUMENTS

| | | | |
|---|---|---|---|
| D. 201,016 | 5/1965 | Holland . | |
| D. 221,118 | 7/1971 | Chambers . | |
| D. 293,287 | 12/1987 | Cauque et al. . | |
| D. 300,582 | 4/1989 | Hodge . | |
| 710,442 | 10/1902 | Downie | 206/815 |
| 806,985 | 12/1905 | Mallory | 206/39.5 |
| 912,110 | 2/1909 | Gill | 206/39.5 |
| 912,905 | 2/1909 | Sims | 206/39.5 |
| 1,066,129 | 7/1913 | Manasse . | |
| 1,658,496 | 2/1928 | Qvarnstrom . | |
| 1,916,119 | 6/1933 | Schwartz et al. | 206/815 |
| 2,195,042 | 3/1940 | Wishinsky . | |
| 2,213,075 | 8/1940 | Ross . | |
| 2,297,285 | 9/1942 | Bledsoe . | |
| 2,572,703 | 10/1951 | Dennis . | |
| 2,628,712 | 9/1953 | Ford . | |
| 2,997,168 | 8/1956 | Tall | 206/815 |
| 3,094,799 | 6/1963 | Hines . | |
| 3,466,774 | 9/1969 | Borresen | 206/232 |
| 4,280,811 | 7/1981 | Howe, Jr. | 206/805 |
| 4,354,601 | 10/1982 | Harrison | 206/232 |
| 4,518,080 | 5/1985 | Ohlson | 206/39 |
| 4,521,981 | 6/1985 | Kasprzycki et al. . | |
| 4,739,877 | 4/1988 | Olsen . | |
| 4,746,018 | 5/1988 | Mueller | 206/447 |
| 4,789,573 | 12/1988 | Jenkinson . | |
| 4,821,934 | 4/1989 | Alessi et al. | 224/252 |
| 4,928,914 | 5/1990 | Rondot et al. | 206/447 |
| 4,932,520 | 6/1990 | Ciarcia et al. | 206/232 |
| 5,060,794 | 10/1991 | Linn et al. | 206/232 |

*Primary Examiner*—David T. Fidei
*Attorney, Agent, or Firm*—Jacobson & Johnson

[57] ABSTRACT

A memo pad device having a frame with a recessed cavity for protectively holding a plurality of sheets of a note pad having a reusable adhesive to allow users to write reminders to themselves, look at them later, do the task and remove either a single sheet or the entire note pad. In one embodiment a frame surrounds a panel which holds a memo pad and a projecting lip attached to the frame holds the free end of the memo pad in place yet permits the free end of a single sheet to be removed by disengaging it from the lip.

5 Claims, 6 Drawing Sheets

PAD HOLDER

CROSS REFERENCE TO RELATED APPLICATIONS

This application is a continuation in part of my copending application Ser. No. 571,993 Titled Reminder Systems filed Aug. 24, 1990, now U.S. Pat. No. 5,060,794 naming Richard A. Linn and Edward J. Goldstein as inventors.

FIELD OF THE INVENTION

This invention relates to the field of devices that remind people to do things, and more specifically, reminding devices with replaceable not pads.

BACKGROUND OF THE INVENTION

As long as time can remember, people have been forgetting things. The present invention of a memo pad key ring attachment device solves the problem of important things being left undone because people forgot to do them. In the prior art, there are several patents showing devices hooked to a key ring including: Hines U.S. Pat. No. 3,094,799, Ford U.S. Pat. No. 2,628,712, Hodge U.S. Pat. No. Des. 300,582, Jenkinson U.S. Pat. No. 4,789,573, Holland U.S. Pat. No. Des. 201,016, and Dennis U.S. Pat. No. 2,572,703. However, none of these inventions are helpful in reminding the user to do something. The prior art of Ross U.S. Pat. No. 2,213,075 and Wishinsky U.S. Pat. No. 2,195,042 do remind the user of their license plate numbers, they do not have the versatility and reusability of the present invention. The Qvarnstorm U.S. Pat. No. 1,658,496 is a small box for containing things like cards, licenses and stamps. Prior art U.S. Pat. No. Des. 293,287 is a design for a key chain, watch, miniature flashlight and photograph holder. It does function to remind an individual of the person or place in the photograph, but again, has little reusability and convenience for use as a day to day reminding device. Two other pieces of prior art which show an invention attached to a key chain are Manasse U.S. Pat. No. 1,066,129 and Bledsoe U.S. Pat. No. 2,297,285. The former is a kind of key ring address book. While it could serve as a device for reminding a user of things, the sheets are pre-punched and pre-cut to fit the case, making it inconvenient to get that certain type of paper, and a cover must be used to protect the sheets, unlike the present invention, where the sheets are exposed and yet protected by the device itself. The latter piece of prior art is a personally embossed key chain with the user's name imprinted on the front.

None of the listed art utilized the capabilities of a combination key ring and memo pad of the present invention. It would be desirable to have a compact memo device (for convenience and the actual reminders) attached to a key chain for "on the go" immediate accessibility that is easy to refill and reuse and permits the user to not only carry the reminder note but to post the note on a particular location.

DESCRIPTION OF THE PRIOR ART

U.S. Pat. No. 4,789,573 is a key ring attachment that produces moire patterns when tilted;

U.S. Pat. No. Des. 293,287 is a combination key ring flashlight, photograph holder and chronometer;

U.S. Pat. No. 1,658,496 is a receptacle for carrying cards, licenses, receipts and the like in a pocket of personal clothing;

U.S. Pat. No. 1,066,129 is a key ring and note or address book concealed in a compartment which is opened by means of hinges;

U.S. Pat. No. Des. 201,016 is a combination key, match book holder;

U.S. Pat. No. Des. 221,118 is a key tag with a hollow interior slot and a clear plastic piece on the front face for viewing the interior tag;

U.S. Pat. No. Des. 2,572,703 is a combination key chain and religious momento device;

U.S. Pat. No. 2,195,042 is a combination key tag and miniature license plate with small removable pieces for the license plate;

U.S. Pat. No. 3,094,799 is a combination key ring and key ring loss prevention device. The loss prevention device consists of a small plastic compartment which can be pryed open. Inside the compartment lies an addressed label with postage ready to be mailed;

U.S. Pat. No. 2,628,712 is a combination key check, I.D. tag, matchbook holder;

U.S. Pat. No. Des. 300,582 is a combination key ring and mirror or picture frame support;

U.S. Pat. No. 2,213,075 is a combination key tag and miniature license plate, with the plate being a small stamped metal piece; and U.S. Pat. No. 2,297,285 is a combination name tag or card holder key chain.

BRIEF SUMMARY OF THE INVENTION

The present invention comprises a frame with a recessed cavity for protectively holding a plurality of sheets from a note pad having a reusable adhesive to allow a user to write reminders to themselves, look at them later, do the task and remove either a single sheet or the entire note pad. In one embodiment the invention comprises a memo pad key ring attachment device comprising a polymer plastic frame with a hole for a key ring or similar device, a resilient panel which holds a memo pad, the resilient panel being cantileverly attached to the frame, a stack of sheets of paper with reusable adhesive on one end to permit user to attach memo pad to panel, a projecting lip attached to the frame which holds the second end of the memo pad in place, allowing the edge of a single sheet to be exposed for removal by flexing resilient panel in one direction, a writing instrument, and a means of frictionally holding the writing instrument to the frame. This device allows a user to use the writing instrument to write a reminder to themselves, and after their objective is completed, they can remove the used sheet to find a new one ready.

DESCRIPTION OF THE PREFERRED EMBODIMENT

Figure 1:
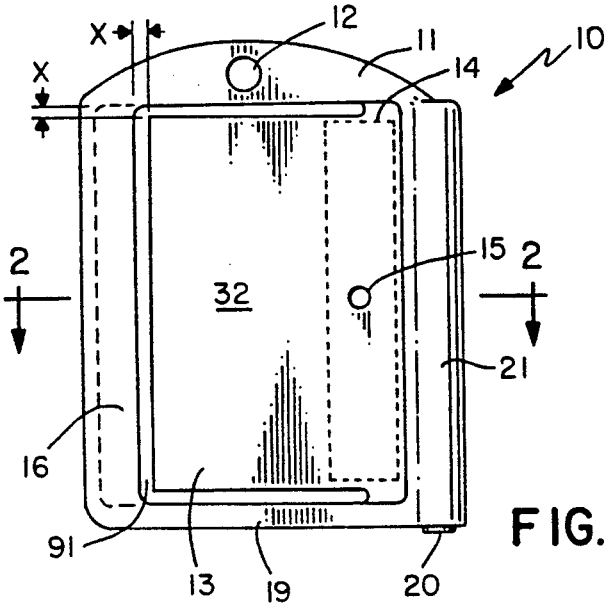
FIG. 1 is a top view of the memo pad key ring attachment.

Referring to FIG. 1, reference numeral 10 generally designates the frame of a one piece memo pad device constructed from a partially flexible polymer plastic. Frame 10 includes a flat end member 19, and a curved end member 11 having a hole 12. Hole 12 permits a user to fasten a key ring to end member 11. End member 11 connects to a side piece 16. Side piece 16 attachs to flat end piece 19, and end piece 19 attachs to a side piece 21, making a plastic rectangular frame consisting of end member 11 and 19, and side pieces 16 and 21.

Extending outward and attached to the bottom portion of side piece 21 to form an attachment means for a note pad, is a resilient panel 13 having a note pad attachment region 14, which is a smooth, flat surface for temporarily attaching an adhesive region of a note pad containing a plurality of sheets of paper thereto.

Note pads are available that have a reusable adhesive located along a portion of one end of the note pad. Generally, the plurality of sheets of paper comprise a stack of individual sheets of paper with a reusable adhesive located in a rectangular strip along one end of one side of each sheet of paper. These note pads allow a user to remove a single sheet from the note pad and temporarily attach the note pad to another object. Such reminder notes pad are commercial available and are sold under the trademark Post-it Notes TM.

Panel 13 also has a small hole 15 in the middle of region 14 so that a user can detach a note pad using a pencil tip or similar device. Resilient panel 13 extends outward from member 21 in a cantilevered manner. A U-shaped slot 91 extends around resilient panel 13 to provide clearance for bending resilient panel 13 free of members 16, 19, and 11. Resilient panel 13 is made of the same polymer plastic as the previously stated pieces, but is sufficiently thin so it is able to bend and flex in response to finger pressure. Region 14 for attaching a stack of note pads thereto is at one end of resilient panel 13 and remains relatively straight as resilient panel 13 flexes in response to pressure from the user thereby minimizing forces that may cause the adhesive from the note pad to pull free of region 14 as the user flexes panel 13.

Implanted in side piece 21 is a small writing pen 20 which is frictionally held in place in member 21.

Figure 2:
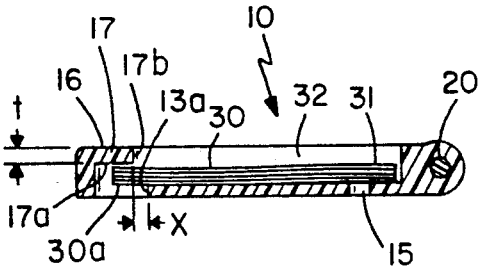
FIG. 2 is a side sectional view taken along lines 2—2 of FIG. 1.
Figure 3:
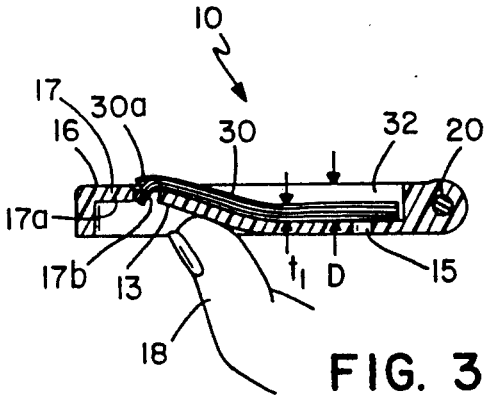
FIG. 3 is a side sectional view taken along lines 2—2 of FIG. 1 showing operation of the resilient panel.

Referring to FIG. 2, Note pad 30 comprises a plurality of sheets of paper adhesively fastened to each other. Note pad 30 is located in a pad protecting recess 32 formed by panel 13 and frame members 11, 16, 19 and 21. The height between top of resilient panel 13 and bottom of an overhanging lip 17 of side piece 16 is equal to t. The top sheet of note pad 50 is located below the top surface of members 16, 19, 21, and 11. Typically t should be sufficiently large so that the top most sheets of the paper on note pad 30 remain below the top surface of frame 10. The letter x denotes the clearance distance between an end 13*a* of resilient panel 13 and an end 17*b* of overhanging lip 17. The clearance x is sufficiently large enough so that a user can flex resilient panel 30 upward with note pad 30 thereon. The necessary clearance depends on the thickness of the stack of note pads. With a thicker stack more clearance should be provided and with a thinner stack, less clearance is necessary. In general the clearance should be kept to a minimum in order to insure that there is a backing support surface under note pad 30. FIG. 3 illustrates how the clearance between end 17*b* and resilient panel 13 permits the user to flex resilient panel 13 upward with note pad 30 to isolate a single top sheet from note pad 30. Located under lip 17 is a note pad free end retaining surface 17*a* that extends over the free end portion 30*a* of note pad 30 to restrain the free end of note pad from bending or curling upward as the user carries the memo pad device in the users pocket or purse. Reference numeral 31 identifies the adhesive region on note pad 30 used to hold the plurality of sheets of paper onto each other and onto the memo pad device 10.

An advantage of the present invention is that a user "on the go" and performing a task can quickly jot down the reminder for a later reminder with a minimum disruption of the users task. That is, if a user is engaged in an involved matter the user may be fearful of forgetting to perform a task at a later time. To eliminate the concern for forgetting the user needs only to reach in his or her pocket and remove the device and write the reminder on the top sheet of note pad 30. If the user wants to remind himself or herself the user can place the device with note pad 30 back in the users pocket for future reference. If the user needs to place a reminder note in a location for others to see the user can easily remove the top sheet of the note pad 30 and temporarily secure the note sheet to a surface to remind another person of performing the task.

FIG. 3 illustrates how a user can remove a single top sheet of paper from the memo pad device. Reference numeral 18 identifies a finger pressing resilient panel 13 in an upward motion thus causing resilient panel 13 to bend and force the edge of top sheet of paper in note pad 30 out of recess 32 and above overhanging lip 17 thus making the top sheet of paper of note pad 30 available for removal. Note the clearance x makes it possible for resilient panel 13 and the free end of note pad 30 to be pushed up to desired position above overhanging lip 17. The distance $t_1$ denotes the height from the bottom of note pad 30 to the top of the same, while distance D is the height between the top of resilient panel 13 and the top of overhanging lip 17. Overhanging lip 17 prevents the non adhesive or free end of note pad 30 from accidently coming off in pocket or purse by preventing the edges of the free end of note pad 30 from catching on the users pocket or purse. Generally the thickness of note pad 30 is such that the individual sheets of note pad 30 remain spaced from the top of the frame in a parallel relationship to panel 13 as illustrated in FIG. 2.

Although a user may want to remove a single sheet of the note pad there may be occasions when a user wants to remove the entire note pad. Reference numeral 15 depicts a hole for the insertion of an object to permit a user to remove entire note pad 30.

Figure 4:
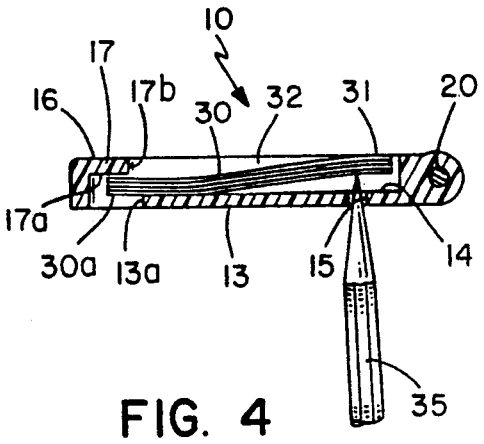
FIG. 4 is a side sectional view taken along lines 2—2 of FIG. 1 showing the removal of a stack of memo sheets.

FIG. 4 shows how a user can remove note pad 30 comprising a stack of a plurality of sheets of paper. Reference numeral 35 identifies a pencil or similar point tipped object extending through hole 15 and pushing the adhesive end of note pad 30 upward and free of surface 14.

Figure 5:
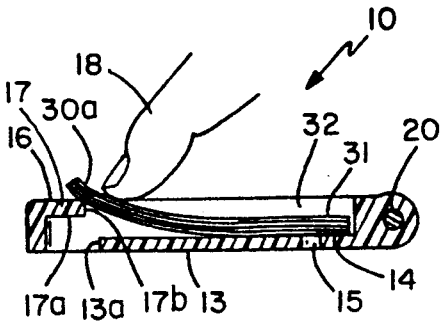
FIG. 5 is a side sectional view taken along lines 2—2 of FIG. 1 showing the insertion of a fresh stack of memo sheets.

FIG. 5 shows a user installing fresh note pad 30 comprised of a plurality of individual sheets of paper into the memo pad device 10. To insert note pad 30 the user places adhesive end portion 31 of note pad 30 onto region 14. The opposite free end of note pad 30 remains suspended above overhanging lip 17. To insert note pad 30 into the recess in memo pad device 10 the user applies downward pressure with finger 18 to forces the free end 30*a* of note pad 30 under overhanging lip 17. Overhanging lip 17 and resilient panel 13 coact to snugly hold the loose or free end of note pad 30 in a non snagging position beneath lip 17.

Figure 6:
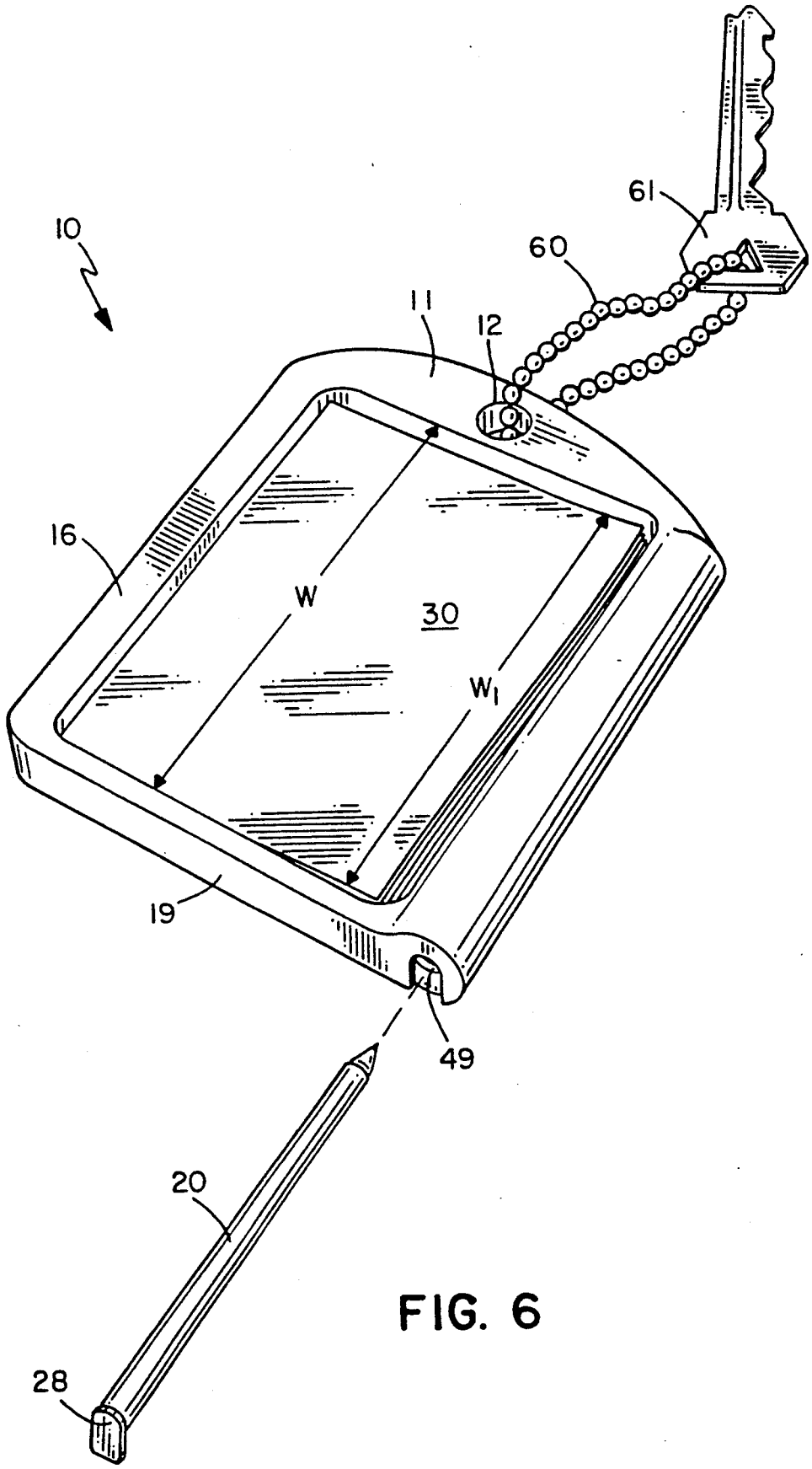
FIG. 6 is an exploded pictorial view of the memo pad key ring attachment device and the writing instrument securing device.

FIG. 6 is a pictorial view of memo pad device 10. The distance $w_1$ is the width of note pad 30 and the measurement w is the distance from the inside of end piece 11 to the inside of end piece 19. More specifically, it is the width between the end units 11 and 19 in the frame. The distance $w_1$ is slightly less than the distance w to permit the sheets of note pad 30 to be freely removed without binding on the edges of memo pad device 10.

Reference numeral 20 identifies a small writing pen having a fingernail engaging lip 28 and an opening 49 in frame 10 having sidewalls for frictionally gripping the cylindrical barrel of pen 20.

Figure 7:
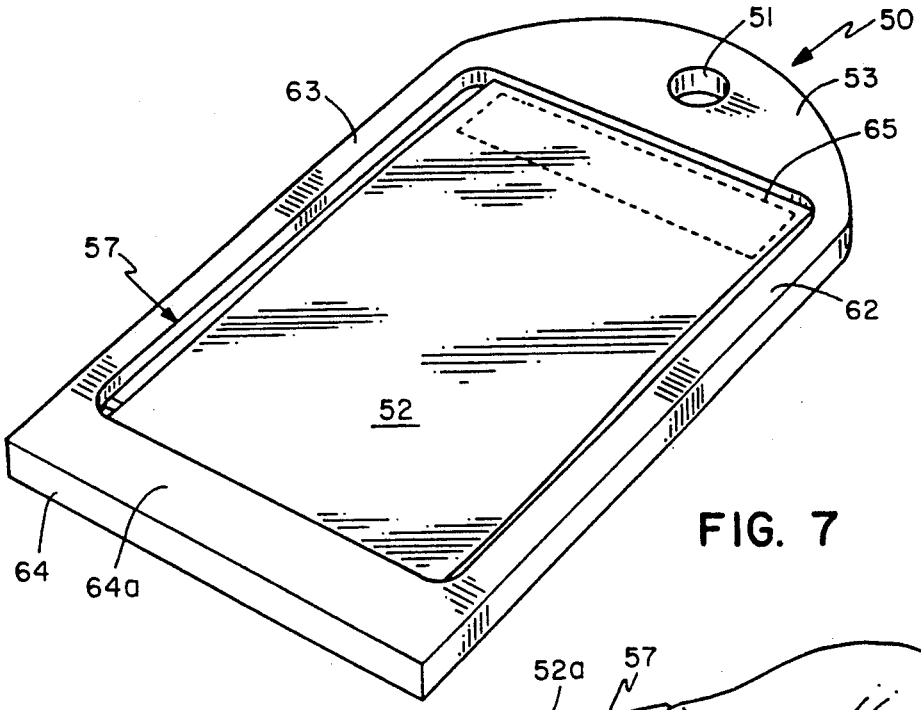
FIG. 7 is a pictorial view of an alternate embodiment.

FIG. 7 shows an alternate embodiment 50 in pictorial view. The embodiment of FIG. 7 is similar to the embodiment of FIG. 1 but lacks the resilient panel for removing a single sheet of material. Alternate embodiment 50 consists of a one piece molded plastic body or frame 53. It includes a rectangular piece of plastic that has been rounded at one end. While body 53 is at a level height, the body has four edges that have been raised to produce a protective recess 57 to hold a note pad 52. Note pad 52 is identical to note pad 30 and comprises a stack of individual sheets of paper secured in place by a strip of reusable adhesive on one end of each sheet of paper. Frame 53 includes a side piece 62, an opposing side piece 63, an end piece 64, and a rounded end piece 65. Rounded end piece 65 has a hole 51. Note pad 52 comprising a plurality of sheets of paper 52 lies in the protective recess 57 in the middle of the alternate embodiment 50. Extending from side to side of memo pad device 50 is a back panel 54 having a flat smooth region 65 for securing note pad 52 with a reusable adhesive thereto.

Figure 8:
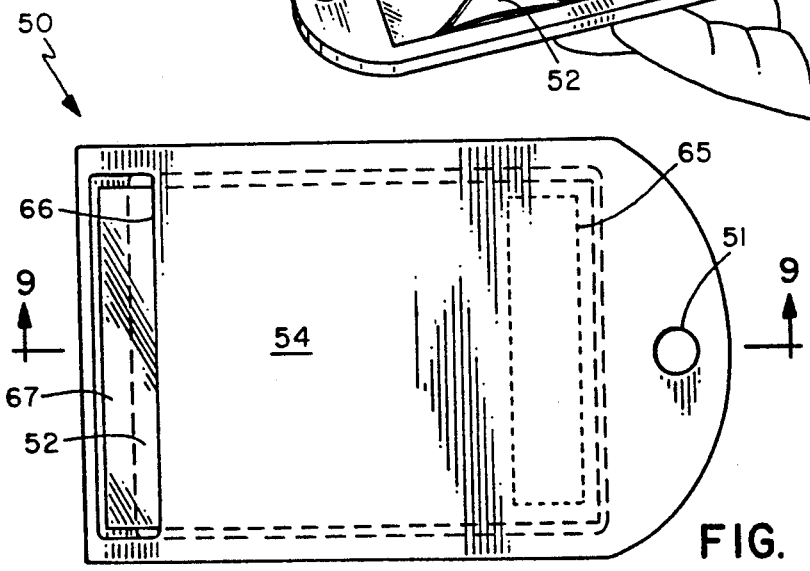
FIG. 8 is a bottom view showing special features of the embodiment of FIG. 7.

FIG. 8 shows a bottom view of the alternate embodiment 50. The bottom panel 54 of the alternate embodiment unlike panel 13 is fixedly mounted to frame 53 and side members 63 and 62. End 66 of panel 54 extends partial toward lip 64*a* but does not extend under lip 64*a*. Reference numeral 67 identifies the free end of note pad 52.

Figure 9:
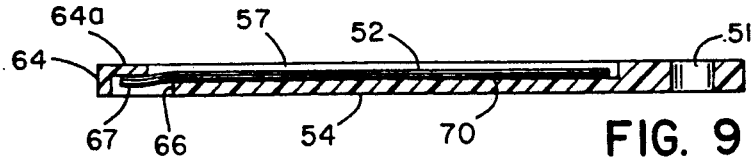
FIG. 9 is a side sectional view of an alternate embodiment taken along lines 9—9 of FIG. 10 is a pictorial view showing a user operating the alternate embodiment.

FIG. 9 is a side cut-away view of the alternate embodiment 50 illustrating the relationship of note pad 52 to frame 53. Lip 64*a* extends slightly above and over free end 67 of note pad 52 to prevent the top sheets in the free end of note pad 52 from catching in user's pocket or purse. Note the lip 64*a* provides a slight downward bending of end 67 of note pad 52 to thereby provide a frictional force to hold the sheets of note pad 52 in recess 57. Reference numeral 54 shows the bottom portion of the alternate embodiment 50, including hole 51 for fastening a key ring chain thereto.

Figure 10:
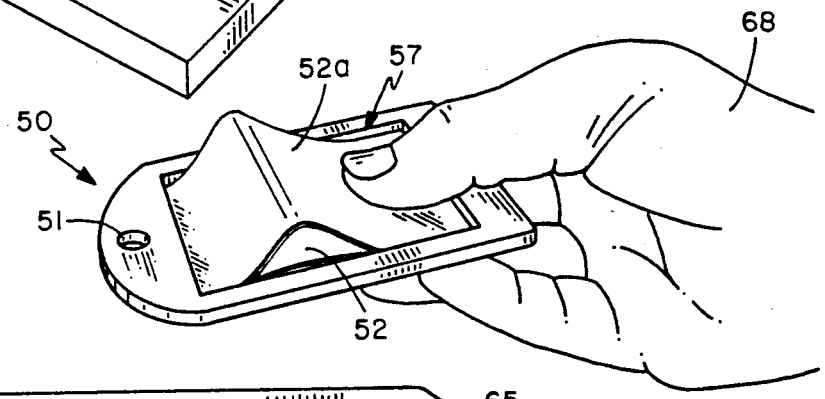

FIG. 10 illustrates how the user can remove a single sheet from memo pad device 50. To remove a top sheet the user places hand 68 with the fingers on panel 54 and the thumb on the top sheet of note pad 52. By frictional engaging the top sheet 52*a* with the users thumb and then pushing the free end of sheet 52*a* laterally toward the adhesive end of note pad 52 the user can slide the free end of top sheet 52*a* out from under lip 64*a* to a position where the user can readily remove top sheet 52*a* from note pad 52.

Figure 11:
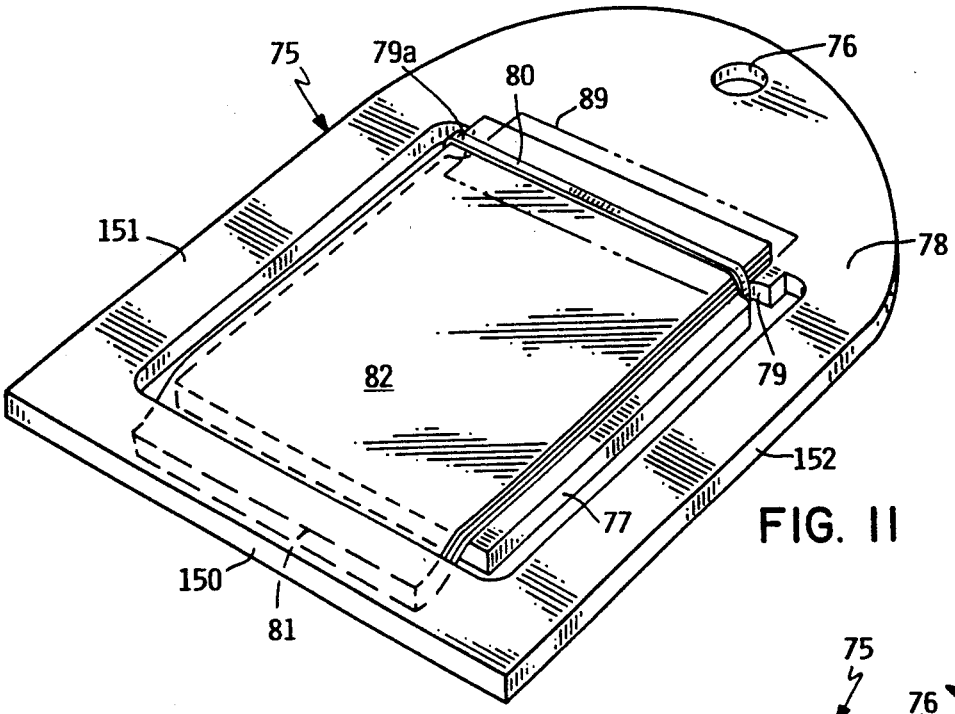
FIG. 11 is a pictorial view of a reminder system cut from a single treated material.

Referring to FIG. 11, reference numeral 75 shows a memo-pad device 75 formed from one piece of material and having a hole 76 for a key ring. The memo-pad device 75 comprises a single sheet of polymer plastic material having a smooth rectangular region identified by 89 for attachment of a sheet of paper having a strip of adhesive material, such as those on Post-It Notes TM or the like. Device 75 includes a curved top member 78, straight end piece 150, and straight side pieces 151 and 152 forming memo-pad device 75. Inside member 75 and pieces 150, 151 and 152 is a resilient support member 77 for providing a support surface for paper pad 82. Note pad 82 comprises a plurality of sheets of paper which are located on top of resilient member 77 with the end 82*a* of the papers 82 placed under lip region 81.

The embodiment of FIGS. 11 to 19 provide for multiple means for holding the stack of papers on the holder. If adhesive backed notes are used the adhesive on the notes is secured to the smooth region 89 and the memo-pad device 75. In order to provide additional support for a note pad, I can also provide a rubber band 80 that fits around the end of the note pad. The advantage of the rubber band is that it is inexpensive and that it can be used as a supplemental holder for the pad. For example, in certain climate conditions the adhesive on the note pads may not continue to secure the pads to the memo-pad device 75. In those instances the user can slip a rubber band around the end of the note pad to provide additional support. As an alternative the user can use note pads without adhesive and allow the rubber band to provide the securing force to hold the paper pad in place.

Resilient panel 77 includes a notch 79 on one side and a further notch 79*a* on the other side for placement of an elastic rubber band 80 there around. While the purpose of this rubber band is to permit use of non-adhesive backed sheets of material 82 in my invention or provide additional holding for adhesive backed sheets the notches prevent the rubber band from slipping down as the user carries the memo-pad device about in his or her pocket.

Figure 12:
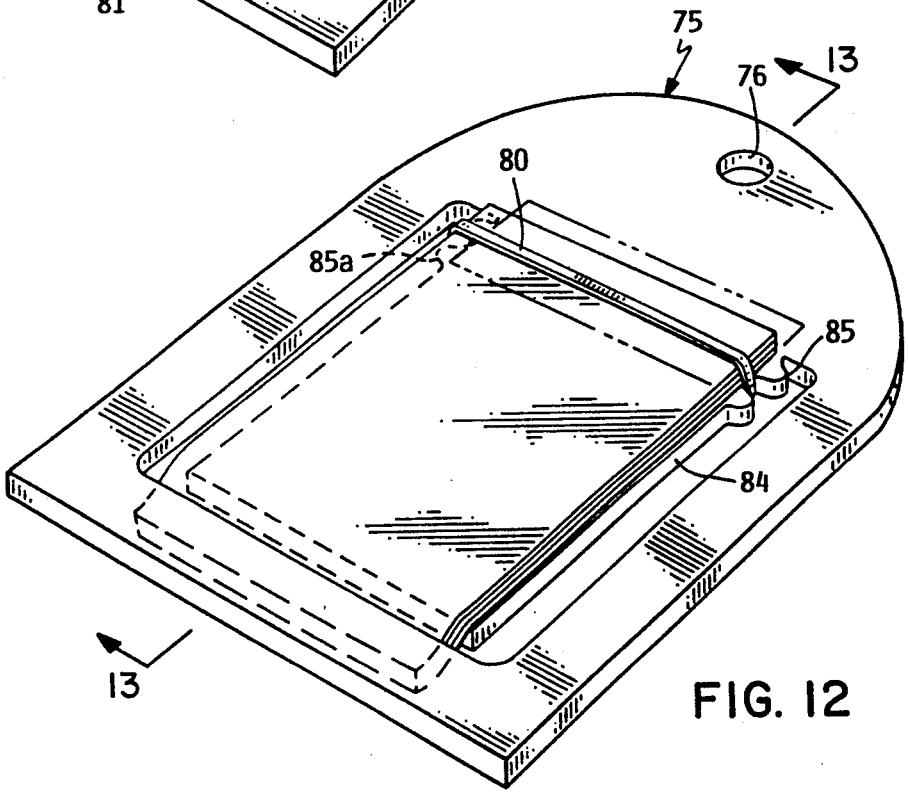
FIG. 12 is a pictorial view of an alternate view of an embodiment of the reminder system cut from a single sheet of material.

FIG. 12 shows an alternate embodiment in which instead of notches 79 and 79*a*, there are ears 85 and 85*a* which project outward from resilient panel 84 to hold rubber band 80 in place. Other features of device 75 are identical to those shown in FIG. 11.

Figure 13:
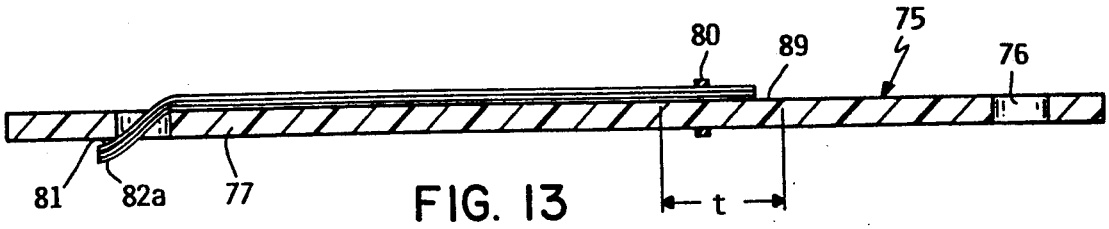
FIG. 13 is a side sectional view taken along line 13—13 of FIG. 12.

FIG. 13 displays a cross-sectional view showing how rubber band 80 wraps around the back panel 77 and the top of the sheets to hold sheets in place and how the ends of sheets 82*a* fit under edge 81.

Figure 14:
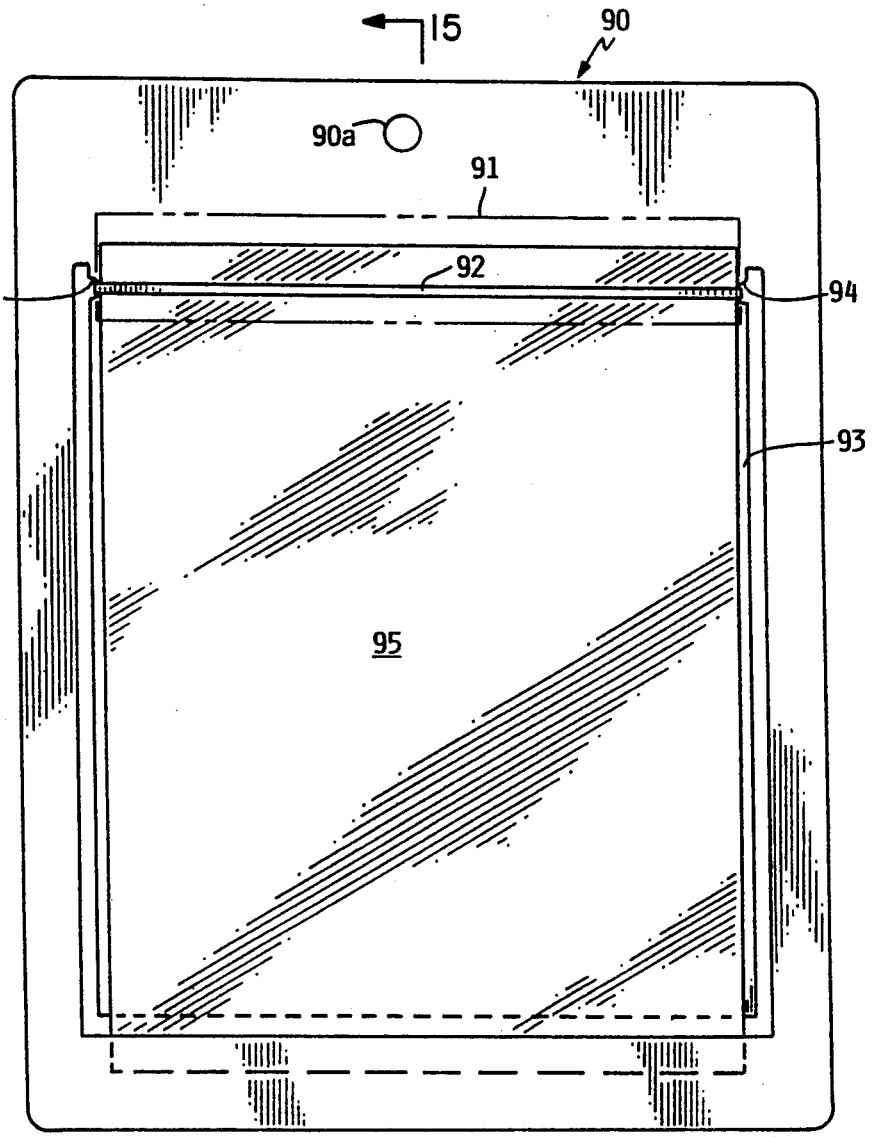
FIG. 14 is a front view of a clip-board like holder for holding larger sheets of paper.
Figure 15:
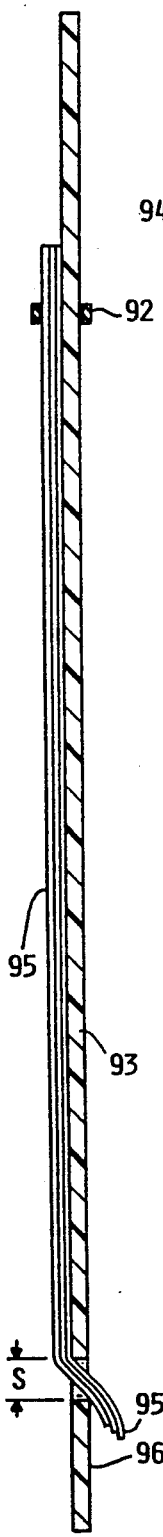
FIG. 15 is a cross-sectional view taken along lines 15—15 in FIG. 14.
Figure 16:
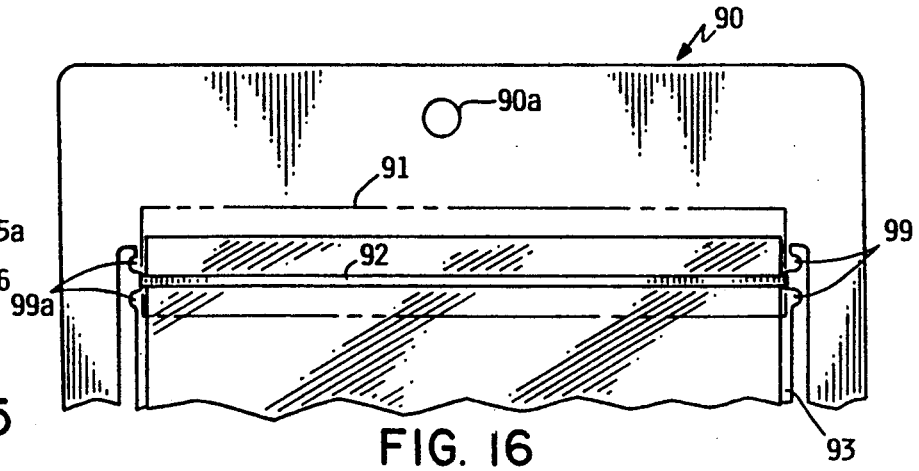
FIG. 16 is a partial front view of an alternate embodiment of a clip-board holder.

Referring to FIGS. 14, 15 and 16, reference numeral 90 identifies a device similar to the memo pad shown in FIGS. 10–13 except member 90 is note book size, i.e. holds approximately 8½ by 11 inch sheets of paper. A hole 90*a* is included for hanging device 90 to a wall or the like. The paper holder system of FIGS. 14–16 comprises a smooth area 91 for securing adhesive backed paper if desired, however in most cases loose sheet papers will be held in place on one end by a rubber band 92 extending through notch 94 and 94*a* on a resilient panel 93. One end of the resilient panel 93 is integrally and cantiverlery connected to the interior of frame 90 while the other end of resilient panel is a free end that can be flexed out of a plane extending through frame 90.

Resilient panel 93 has sufficient resiliency so that it generates a restoring force that normally returns the resilient panel to the straight position as shown in FIG. 15. With a restoring force from resilient panel 93 edge 96 holds down edge 95*a* of paper by applying a bending force to the end of paper 82 between lip 96 and the free end of resilient panel 93 as the resilient panel returns to the plane extending through resilient panel 93 and lip 96 when there is no stack of sheets of paper present on said resilient panel.

FIG. 16 shows an alternate embodiment with ears 99 and 99*a* for having an elastic band 92 in place.

Figure 17:
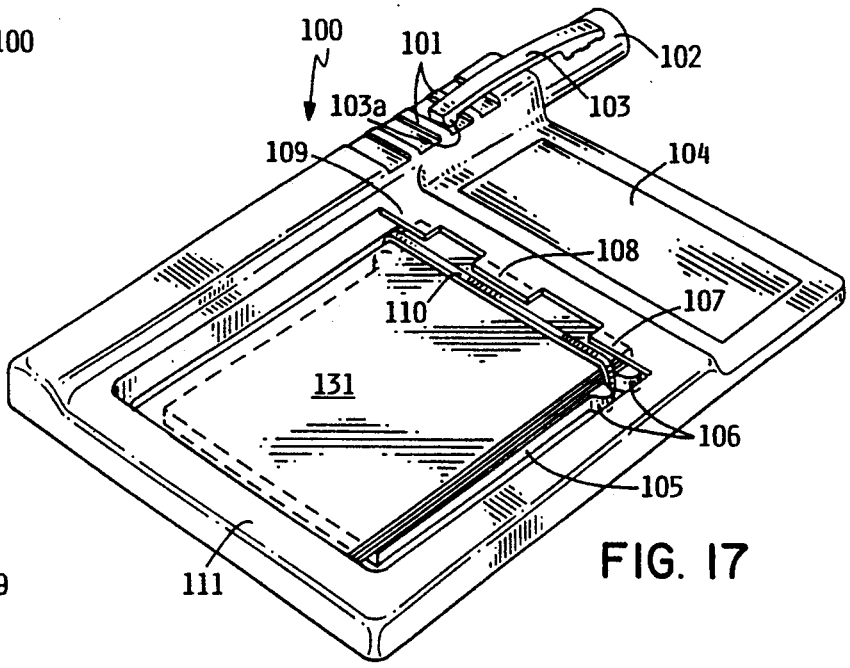
FIG. 17 is a pictorial view of a pocket holder reminder system.

Referring to FIG. 17, reference numeral 100 identifies a shirt pocket reminder system for insertion into the user's shirt pocket or the like. Reminder system 100 includes a compartment or pocket for holding a writing instrument such as a pen 102, having a clip 103. Located perpendicular to the pocket and on the front face are a series of ridges 101 which engage pen clip ridge 103*a* to hold the pen in the pocket. Located on the side of holder 100 and adjacent to the compartment are different size ridges to different shapes pens (not shown). Similarly, located on the back of holder 100 is an elongated recess to accomodate still other shape pen clips. The purpose of the ridges 101 is to provide a surface to secure the pen to since typically pens are clamped against a flexible cloth. In the present invention it is envisioned the pocket reminder system can be made of a rigid plastic and yet hold pens in place by use of ridges. Reminder system 100 includes an advertising area 104 located at the top of the unit for printing information such as a company logo or the user's name. Located below advertising area 104 is a recessed compartment for holding loose sheets of paper without bending the ends of the paper. The device is similar to that shown in FIGS. 1 through 5; however, the resilient panel 105 includes ears 106 on one side and ears 109 on the opposite side so that a rubber band 110 can be secured around to hold sheets in place. If the rubber band is not desired, there are provided lips 109 and 107 on the front side for holding the sheets in place.

Figure 19:
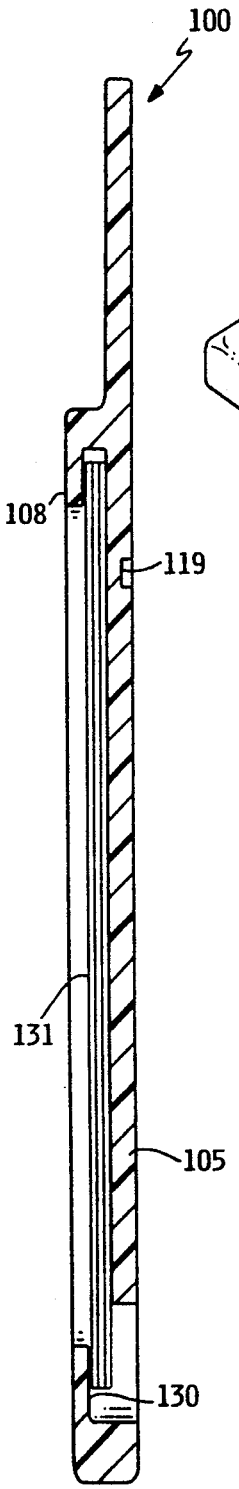
FIG. 19 is a cross-sectional view taken along lines 19—19 of FIG. 18.

FIG. 19 illustrates that a stack of sheets of paper 131 are held in a straight position by lips 108 and 130 and by a resilient panel 105. An individual sheet of paper can be removed by flexing resilient panel away from lips 130 and 108 to permit a user to slide out the paper. The use of device 100 is suitable for business cards or the like since the cards can be held in place without adhesive and can be stored and removed without bending the end of the business card.

A back view reveals the pocket holder 100 without the rubber band and reveals a recess 119 located in the back. Recess 119 is placed on the back of the resilient panel 105 to provide the necessary relief to control the flexibility of the panel. That is, in order to provide proper resiliency to back panel 105 one can provided a weakened area as evidenced by recess 119. The removal of material from a selected area allows one to accurately determine where the flexure point is located as well as control the amount of resiliency of the panel. That is, a heavier non resilient panel that has little flexibility could be used by merely removing a portion of the panel to produce a region that permits bending and flexing of the panel.

Figure 18:
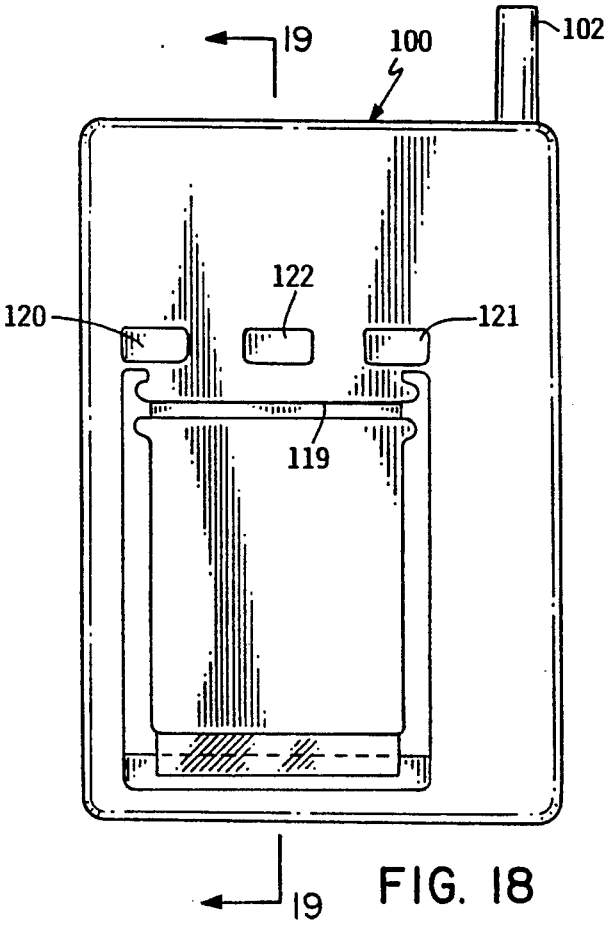
FIG. 18 is a back view of the pocket holder reminder system of FIG. 17.

In FIG. 18 and 19 the rubber band 110 has been removed to show that the pocket reminder system 100 can be used to hold business cards or the like with only the ears and the resilient panel 105.

The back view indicates openings 120 and 121 for injection molding of lips 109 and 106 in the front of the device.

The pocket reminder system of FIGS. 17 through 19 has a flexible resilient panel 105 for insertion and removal of sheets which are held in a protected pocket in reminder system 100. FIG. 19 shows that the stack 131 located in a position supported on one side by panel 105 and on one end by lip 108 and the opposite end by lip 130. Consequently items such as business cards or the like can be attached to device 100 and held in position in a clean and fresh condition.

An advantage of the pocket reminder system 100 is that it holds essential information in a clear fresh state. That is, the pocket reminder system 100 permits one to hold business cards or the like as well as to hold a pen and advertising information. The resiliency of panel 105 permits one to bend panel 105 backward so that the papers 131 inserted therein are not bent during the installation process. Once in place the lips 108, 109, 130 coact with panel 105 to confine the papers within the thickness of the pocket reminder system 100. That is there are not exposed edges to become curled or damaged as the pocket reminder system 100 is carried in a user's pocket.

I claim:

1. A device to be carried about in a users pocket or purse with the device operable for holding a stack of individual sheets of paper without bending the papers comprising:

a one piece frame;

a panel, said panel integrally and cantileverly connected to said frame, said panel having a region for fastening a stack of individual sheets of paper to said panel, said panel and said frame co-acting to form a protective recess for protectively receiving and storing the stack of individual sheets of paper; and a first lip mounted on said frame and extending at least partially over said region for fastening the stack of individual sheets of paper, said first lip extend over a first end of the stack of individual sheets of paper;

a second lip mounted on said frame, said second lip spaced from said panel, said second lip projecting inward into said protective recess said second lip extending over a second end of the stack of individual sheets of paper to sandwichingly hold said second end of the stack of individual sheets of paper between said resilient panel and said second lip, said second lip coacting with said panel to form means for holding a free end of the stack of individual sheets of paper between said second lip and said panel, said second lip and said panel spaced sufficiently far from each other to permit a user to flex said panel to thereby remove an individual sheet of paper from the stack of individual sheets of paper by forcing the free end of an individual sheet of paper out of said protective recess so that a user can remove the individual sheet of paper to thereby expose an unused sheet paper.

2. The device of claim 1 including a a compartment located in said frame for holding a writing instrument including a set of ridges located on said frame proximate said compartment for a writing instrument so that a clip on a writing instrument can engage said ridges and retain the writing instrument in said device.

3. The device of claim 1 including a second region for placing an advertising slogan thereon.

4. The device of claim 1 including recesses on said frame for molding lips onto said frame.

5. The device of claim 1 including a recess located on said resilient panel to provide a weakened area on said resilient panel to thereby form a resilient hinge to control the flexing of said resilient panel.

* * * * *